US008426780B2

(12) United States Patent
Schlipf

(10) Patent No.: US 8,426,780 B2
(45) Date of Patent: Apr. 23, 2013

(54) HEATING CARTRIDGE WITH COUPLING ELEMENT

(75) Inventor: Andreas Schlipf, Tuttlingen (DE)

(73) Assignee: Türk & Hillinger GmbH, Tuttlingen (DE)

( * ) Notice: Subject to any disclaimer, the term of this patent is extended or adjusted under 35 U.S.C. 154(b) by 1372 days.

(21) Appl. No.: 12/124,411

(22) Filed: May 21, 2008

(65) Prior Publication Data

US 2008/0290085 A1 Nov. 27, 2008

(30) Foreign Application Priority Data

May 22, 2007 (DE) ..... 20 2007 007 270 U
Jun. 25, 2007 (DE) ..... 20 2007 008 404 U

(51) Int. Cl.
*H05B 3/06* (2006.01)

(52) U.S. Cl.
USPC ..... 219/526; 219/541; 219/544; 219/534; 219/535

(58) Field of Classification Search ..... 219/526, 219/541, 544, 534, 523, 535–540, 542; 338/296–305, 230, 232, 238–246
See application file for complete search history.

(56) References Cited

U.S. PATENT DOCUMENTS

| | | | | | |
|---|---|---|---|---|---|
| 744,974 | A | * | 11/1903 | McElroy | 338/298 |
| 1,365,978 | A | * | 1/1921 | Gallager | 219/530 |
| 2,369,045 | A | * | 2/1945 | Hampton et al. | 338/250 |
| 2,831,951 | A | * | 4/1958 | Desloge | 338/241 |
| 2,840,676 | A | | 6/1958 | King | |
| 3,080,543 | A | * | 3/1963 | Boggs | 338/273 |
| 3,252,122 | A | * | 5/1966 | Baxter | 338/271 |
| 3,307,135 | A | | 2/1967 | Simmons | |
| 3,582,616 | A | * | 6/1971 | Wrob | 219/541 |
| 3,632,978 | A | * | 1/1972 | Wrob | 392/498 |
| 3,839,623 | A | | 10/1974 | Portmann | |
| 3,881,163 | A | * | 4/1975 | Lindroth et al. | 338/302 |
| 3,890,485 | A | * | 6/1975 | Kozbelt | 219/523 |
| 4,086,465 | A | | 4/1978 | Sylvester | |

(Continued)

FOREIGN PATENT DOCUMENTS

| | | |
|---|---|---|
| DE | 1 297 251 | 6/1969 |
| DE | 16 90 679 | 6/1971 |

(Continued)

*Primary Examiner* — Henry Yuen
*Assistant Examiner* — John Wasaff
(74) *Attorney, Agent, or Firm* — McGlew and Tuttle, P.C.

(57) ABSTRACT

A heating cartridge is intended especially for a thermostatic working valve. The cartridge is provided with a resistance wire winding (3), which is wound on a winding support (2) and is embedded in an insulating material filling (5) in a metal sheathing (7). The metal sheathing (7) is provided at one end (6) with a dimensionally stable coupling element (8) manufactured from a plastic, in which connecting lines (17, 18) are arranged, which electrically connect pluggable contact elements, especially pins (9, 10) of a connector plug, to the ends of the resistance wire winding (3). To simplify the manufacture and to obtain a compact design, the connecting lines (17, 18) are rigidly seated in the coupling element (8). The coupling element (8) is designed as a connector plug (8/1) and/or holder (8/2) and it has a connection section (28*a*, 28*b*, 28*c*), which protrudes into the open end of the metal sheathing (7) and which is fastened in the metal sheathing (7) in a non-positive and/or positive-locking manner by preferably radial pressing and forms a dimensionally stable structural unit with same.

20 Claims, 7 Drawing Sheets

U.S. PATENT DOCUMENTS

| | | | | | |
|---|---|---|---|---|---|
| 4,287,502 | A | | 9/1981 | Nickmeyer | |
| 4,300,038 | A | * | 11/1981 | Schwarzkopf | 219/544 |
| 4,308,448 | A | * | 12/1981 | von der Beck et al. | 219/552 |
| 4,346,287 | A | * | 8/1982 | Desloge | 219/541 |
| 4,510,377 | A | * | 4/1985 | Merritt et al. | 219/550 |
| 4,763,102 | A | * | 8/1988 | Ritt | 338/240 |
| 5,034,595 | A | * | 7/1991 | Grendys | 219/541 |
| 5,136,143 | A | * | 8/1992 | Kutner et al. | 219/544 |
| 5,247,158 | A | * | 9/1993 | Steinhauser et al. | 219/544 |
| 7,019,269 | B2 | * | 3/2006 | Okuda | 219/544 |

FOREIGN PATENT DOCUMENTS

| | | | | |
|---|---|---|---|---|
| DE | 1 565 513 | | | 11/1972 |
| DE | 31 17 069 | | | 3/1982 |
| DE | 31 53 393 | C2 | | 3/1982 |
| DE | 34 27 207 | A1 | | 2/1986 |
| DE | 203 08 941 | | | 11/2003 |
| EP | 0 579 444 | A1 | | 1/1994 |
| FR | 2 623 043 | A1 | | 5/1989 |
| GB | 1186045 | A | * | 4/1970 |

* cited by examiner

HEATING CARTRIDGE WITH COUPLING ELEMENT

CROSS REFERENCE TO RELATED APPLICATIONS

This application claims the benefit of priority under 35 U.S.C. §119 of German Patent Application DE 20 2007 007 270.8 filed May 22, 2007 and German Patent Application DE 20 2007 008 404.8 filed Jun. 25, 2007, the entire contents of each of which are incorporated herein by reference.

FIELD OF THE INVENTION

The present invention pertains to a heating cartridge, especially a thermostatic working valve, with a resistance wire winding, which is wound on a winding support and is embedded in an insulating material filling in a metal sheathing, which is provided at one end with a dimensionally stable coupling element, which is manufactured from a plastic and in which connecting lines are arranged, which electrically connect pluggable contact elements, especially pins of a connector plug, to the ends of the resistance wire winding.

BACKGROUND OF THE INVENTION

In a heating cartridge of this type (DE 203 08 941 U1), the metal sheathing is provided at one end with a flange, which is directed all round radially outwardly and which is directly embedded in the holder consisting of an injection-molded plastic part and is preferably fitted together with same during the shaping thereof, i.e., during the injection molding operation, to form one assembly unit. The electrical connecting lines are also embedded in the body of the holder and connected in the process to the plug contacts of a plug extending at right angles to the axis of the heating cartridge.

Aside from the fact that the extrusion coating of the flange leads to a larger outside diameter of the holder in this area, it cannot be avoided that a part of the metal sheathing must be extrusion coated as well. This means that the holder requires much space in the area of the end section of the metal sheathing, which space is not available in some applications.

A tubular heating element with a metal sheathing, in which the open end of the metal sheathing is closed by a closing plug consisting of an insulating material, is known from DE 31 17 069 C2. A winding support made of a ceramic material, which is provided with the heating coil and is surrounded by granular insulating material in the metal sheathing, has two axial holes, in which contact pins, which are in contact with the lead-out wires, are accommodated. These contact pins pass through two holes of the closing plug such that the ends of the contact pins close flush with the outer front surface of the closing plug. The blank ends of connecting lines are introduced for contacting into front-side axial holes, which are radially offset by about half the diameter of the contact pins in relation to the contact pins. The contacting fastening of these connecting lines is brought about by radial pressing of the metal sheathing in the area of the closing plug. The end of the metal sheathing, which is tapered by pressing, may be provided with an additional sleeve, optionally with an additional closing piece. However, a coupling element with pluggable contact elements is not provided for in this tubular heating element.

SUMMARY OF THE INVENTION

The basic object of the present invention is to provide a heating cartridge of the type mentioned in the introduction in an easy-to-carry-out manner with a holder, which is preferably combined with a connector plug, which requires little space in the end area of the metal sheathing both radially and vertically and otherwise simplifies handling and optimizes the possibilities of application and use of the heating cartridge.

This object is accomplished according to the present invention by the connecting lines being rigidly seated in the coupling element, by the coupling element being designed as a connector plug and/or holder and having a connection section, which protrudes into the open end of the metal sheathing and which is fastened in the metal sheathing by preferably radial pressing in a non-positive and/or positive-locking manner and forms a dimensionally stable structural unit with same.

Depending on the particular application, it may be expedient and advantageous if the connector plugs and the holder form a one-piece injection-molded part.

A connection cable or other connections between the holder and the connector plug may now be eliminated.

The possibilities of use and application are greatly expanded and improved because of the smaller space requirement with the type of connection according to the present invention between the holder and the heating cartridge. In addition, this connection can also be manufactured more easily and reliably because a centered fastening of the metal sheathing of the heating cartridge, which metal sheathing is provided with the holder, can be prepared in a press mold in a simpler manner, i.e., with a reduced technical effort. It is, above all, of considerable advantage that the insertion of the metal sheathing equipped with the winding support and the heating coil and filled with the granular insulating material into an injection mold is eliminated.

Other advantageous embodiments are disclosed with the embodiment having the ends of the connecting lines mechanically connected to the winding support to form an assembly unit that can be handled uniformly before insertion in the metal sheathing, considerably facilitating mounting.

As is shown by the exemplary embodiments described below, the present invention can be embodied in at least four different ways:

The coupling element, which also forms the upper closure of the heating cartridge and contains the electrical connection parts, may be designed 1) as a connector plug only, 2) as a holder only, 3) as a combined connector plug with a holder or 4) as a holder, which is connected by an electrical cable to a connector plug.

The present invention will be explained in more detail below on the basis of the drawings. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
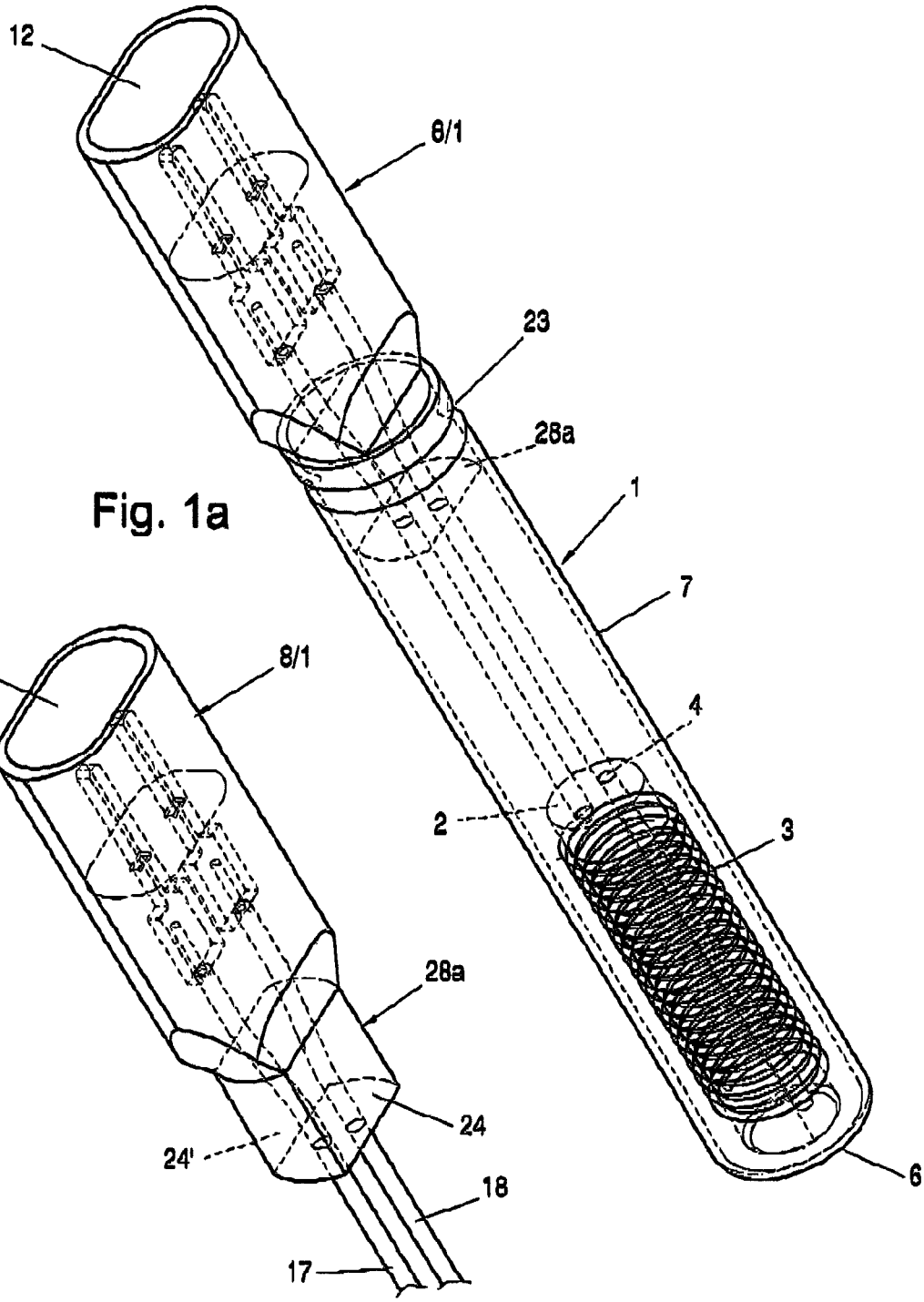
FIG. 1 is a 3D view of a heating cartridge with a coupling element, which is designed as a connector plug.

Referring to the drawings in particular, a heating cartridge 1 shown as an example in the drawings comprises a resistance wire winding 3 wound on a cylindrical winding support 2. The winding support 2 consists of an electrically non-conductive material, for example, ceramic, and it has at least one hole 4, which extends continuously axially and through which the lower end of the resistance wire winding 3 can be passed upwardly.

The winding support 2 with its resistance wire winding 3 wound upon it is embedded in an insulating material filling 5, which may consist, for example, of a metal oxide, preferably magnesium oxide, and which is located in a metal sheathing 7 closed at the lower front side 6.

Figure 1A:
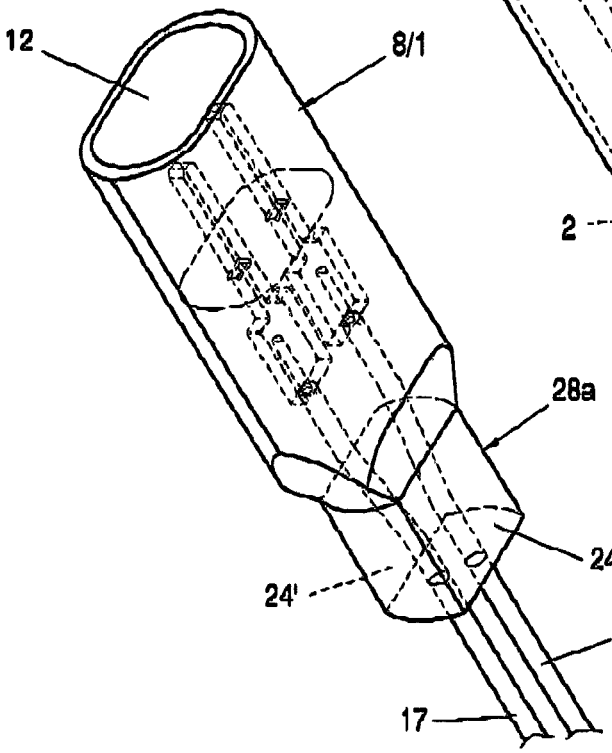
FIG. 1*a* is a 3D view of the coupling element according to FIG. 1 as an individual part with electrical connection parts.
Figure 1B:
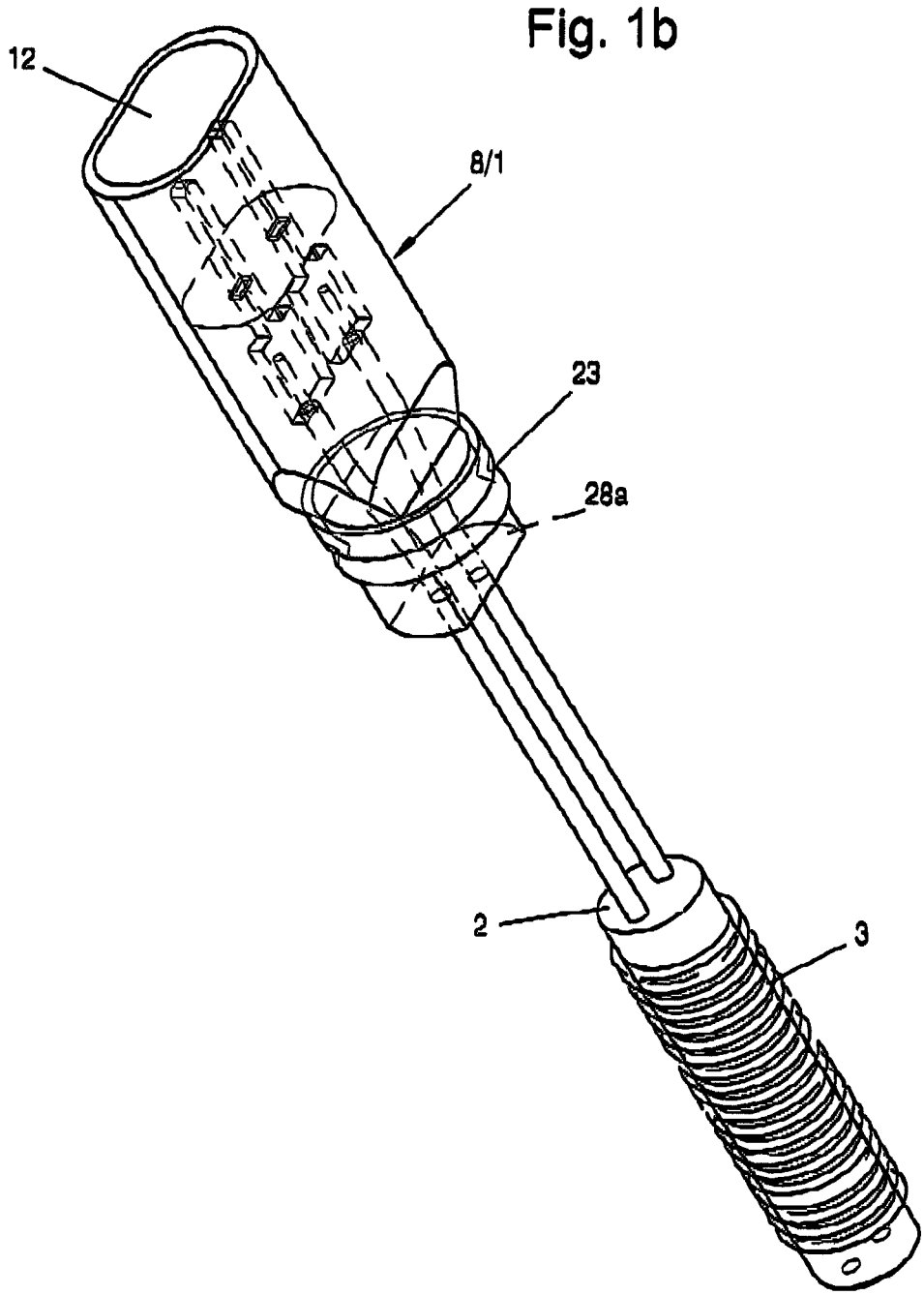
FIG. 1*b* is a 3D view of the coupling element and the winding support as an assembly unit that can be handled uniformly.

A coupling element 8, which is manufactured from an injection-molded plastic and is designed as a connector plug 8/1 in the embodiment according to FIGS. 1, 1*a*, 1*b* as well as 4 through 11, is arranged at the upper end of the metal sheathing 7. This connector plug 8/1 is provided with two pins 9 and 10, which extend in parallel to one another. These pins 9 and 10 are located in a cavity 12 of the connector plug 8/1, the cavity being open on the front side. It can be recognized, e.g., from FIGS. 2 and 3 that the pins 9 and 10 extend axially in parallel and symmetrically to the axis 11 of the metal sheathing 7 and of the heating cartridge 1.

The pins 9 and 10 are provided, moreover, with thickened foot parts 13, which have a rectangular cross section and with which they are embedded in the body of the coupling element 8 or of the connector plug 8/1. In other words, these foot parts 13 and the lower section of the two pins 9 and 10 are completely extrusion-coated, so that they have a stable position.

The foot parts 13 of these pins 9 and 10 are provided on the underside with axially parallel holes 14 each, into which the upper ends 15 and 16, respectively, of two connection wires 17 and 18 of the resistance wire winding 3 are plugged in a contacting manner. This contacting of the wire ends 15 and 16 with the foot parts 13 of the pins 9 and 10 may be embodied by non-positive connection (pressing) and/or connection in substance (soldering, welding).

Instead of such connection wires 17 and 18, it is also possible to provide any other, suitable type of connection as an electrical connection between the resistance wire winding 3 and the pins 9, 10. Thus, the pins 9, 10 with their foot parts 13 and the connection wires 17, 18 may also be of a one-piece design and made, for example, of a punched part.

In other words, the pins 9, 10 may, however, also be provided, if they are manufactured, for example, in a suitable punching and embossing process, with electrical connection pieces, which are made integrally in one piece with them and via which they are connected to the lead-out wires.

The connecting line may also consist as a two-part line from two non-sheathed parts, which are welded or soldered to one another.

The connection wires 17 and 18 may be provided with an insulating jacket 19 over their length extending between the winding support 2 and the foot parts 13, which is, however, not absolutely necessary, because it is surrounded by insulating materials anyway.

While the connection wire 17 is connected to the upper end 20 of the resistance wire winding 3, the connection wire 18 within the hole 4 of the winding support 2 is in electrically conductive connection with the lower end 21 of the resistance wire winding 3. It is advantageous in this connection to provide in the winding support 2 a second through hole 4, in which the lower end of the connection wire 17 and the connection thereof to the upper lead-out wire 20 is accommodated.

A mechanical connection is also established between the coupling element 8 and the winding support 2 by the lower ends of the connection wires 17, 18, which are introduced into the holes 4 of the winding support 2 at least with a perceptible tensioned seat, so that the winding support 2 can be easily introduced into the metal sheathing 7 in terms of manufacturing technology by the winding support being guided at the coupling element.

As is shown in FIG. 1*b*, the winding support 2 and the coupling element 8 represent, due to this connection via the connection wires 17, 18, a structural assembly unit, which can be handled uniformly and by which mounting is considerably simplified and hence made considerably less expensive.

Figure 4:
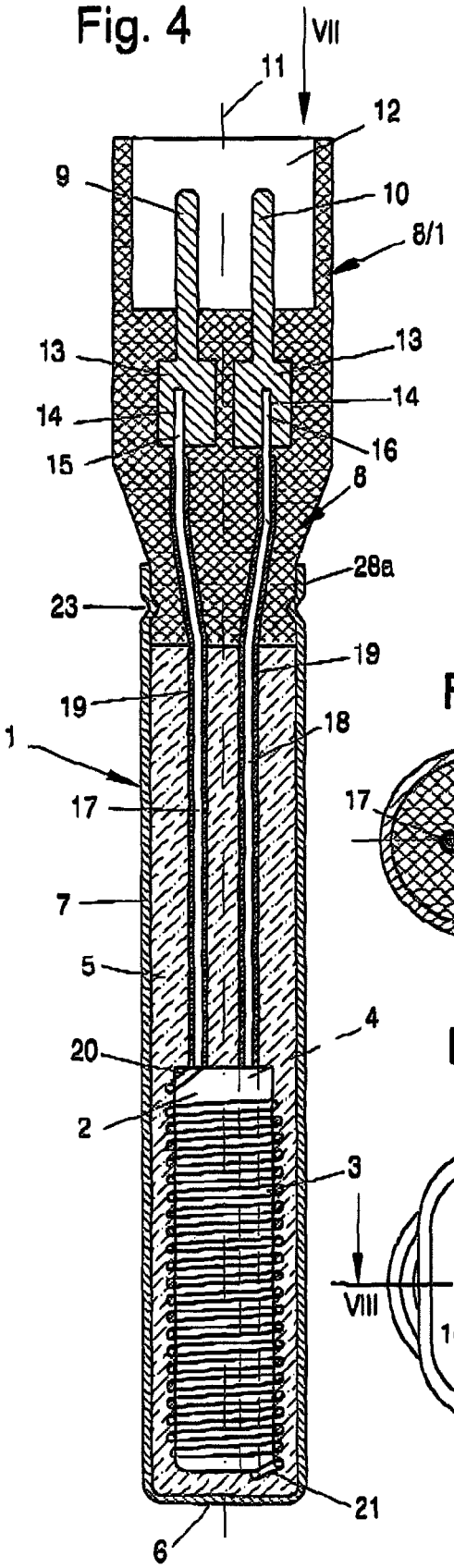
FIG. 4 is a longitudinal section of the heating cartridge shown in FIG. 1 according to section line IV-IV from FIG. 7.
Figure 5:
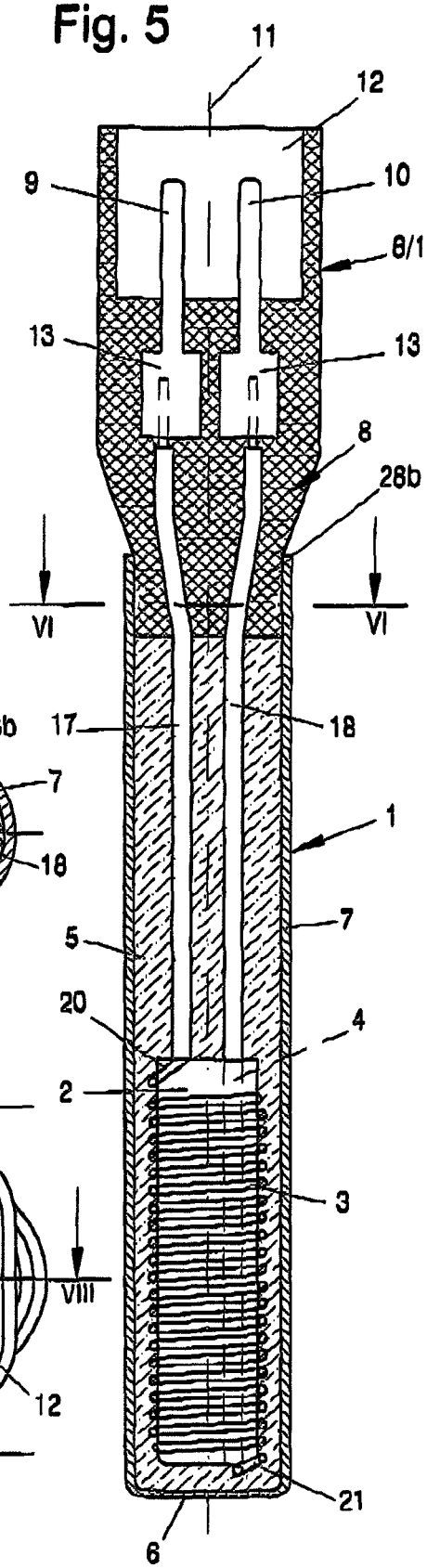
FIG. 5 is the same sectional view as FIG. 4, but in another embodiment of the metal sheathing and of the connection section.

As is apparent especially from FIGS. 4 and 5, the upper sections of the connection wires 17 and 18 are embedded each in the insulating material filling 5 and in the injection molding of the holder 8 and are completely surrounded by these, i.e., the upper sections of the connection wires 17, 18 are rigidly seated, just as the pins 9, 10 in the coupling element 8.

The coupling element 8 may be designed, according to FIGS. 1, 1*a* and 4 through 11, as a connector plug 8/1, which forms the upper closure of the metal sheathing 7 and hence of the heating cartridge 1.

Figure 2:
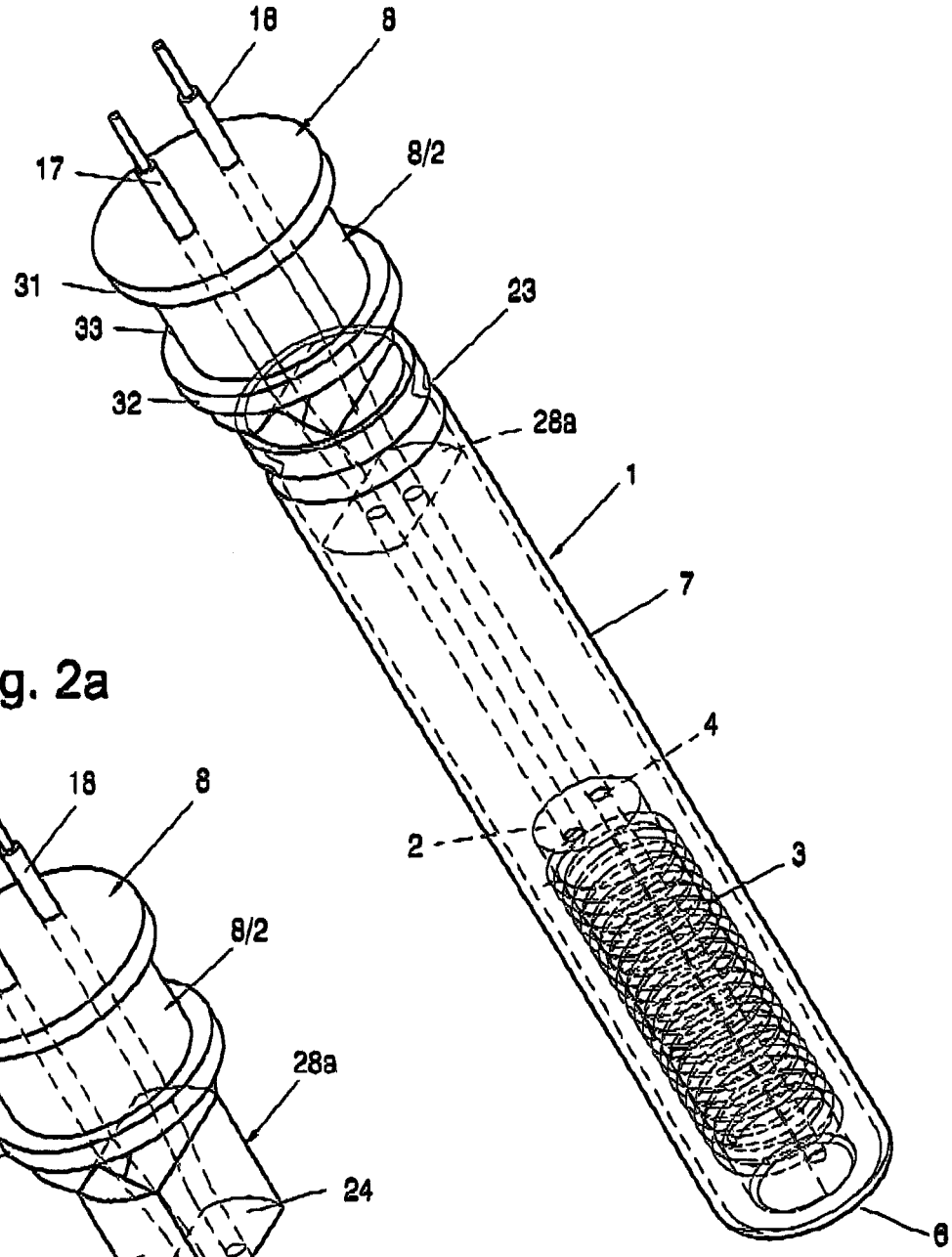
FIG. 2 is a 3D view of a heating cartridge with a coupling element, which is designed as a holder.
Figure 2A:
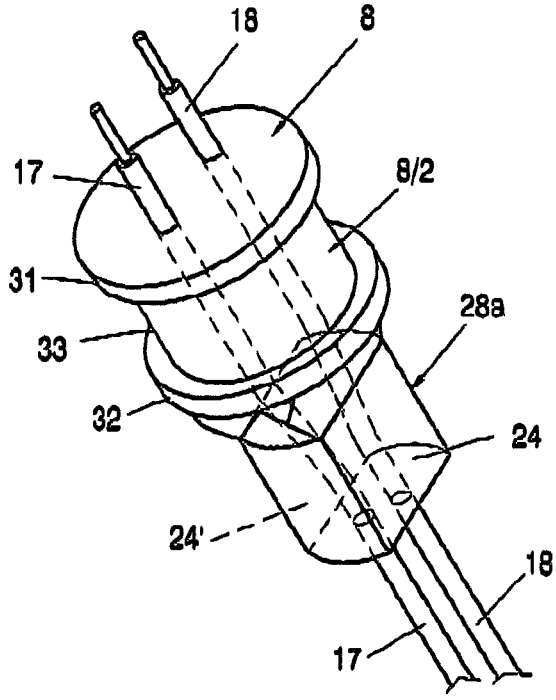
FIG. 2*a* is a 3D view of the holder as an individual part with electrical connection parts.

As is shown in FIGS. 2 and 2*a*, the coupling element 8 may, however, also be designed as a holder 8/2 only, whose outer shape is indicated only schematically in the exemplary embodiment, but this shape depends on the particular application and the receiving means of the coupling element. The cylindrical shape with the two movable flanges 31 and 32 and the annular groove 33, which is located between them and with which the holder 8/2 is being shown here, shall show only one of many possibilities of shaping, which depends on the particular application.

Figure 3:
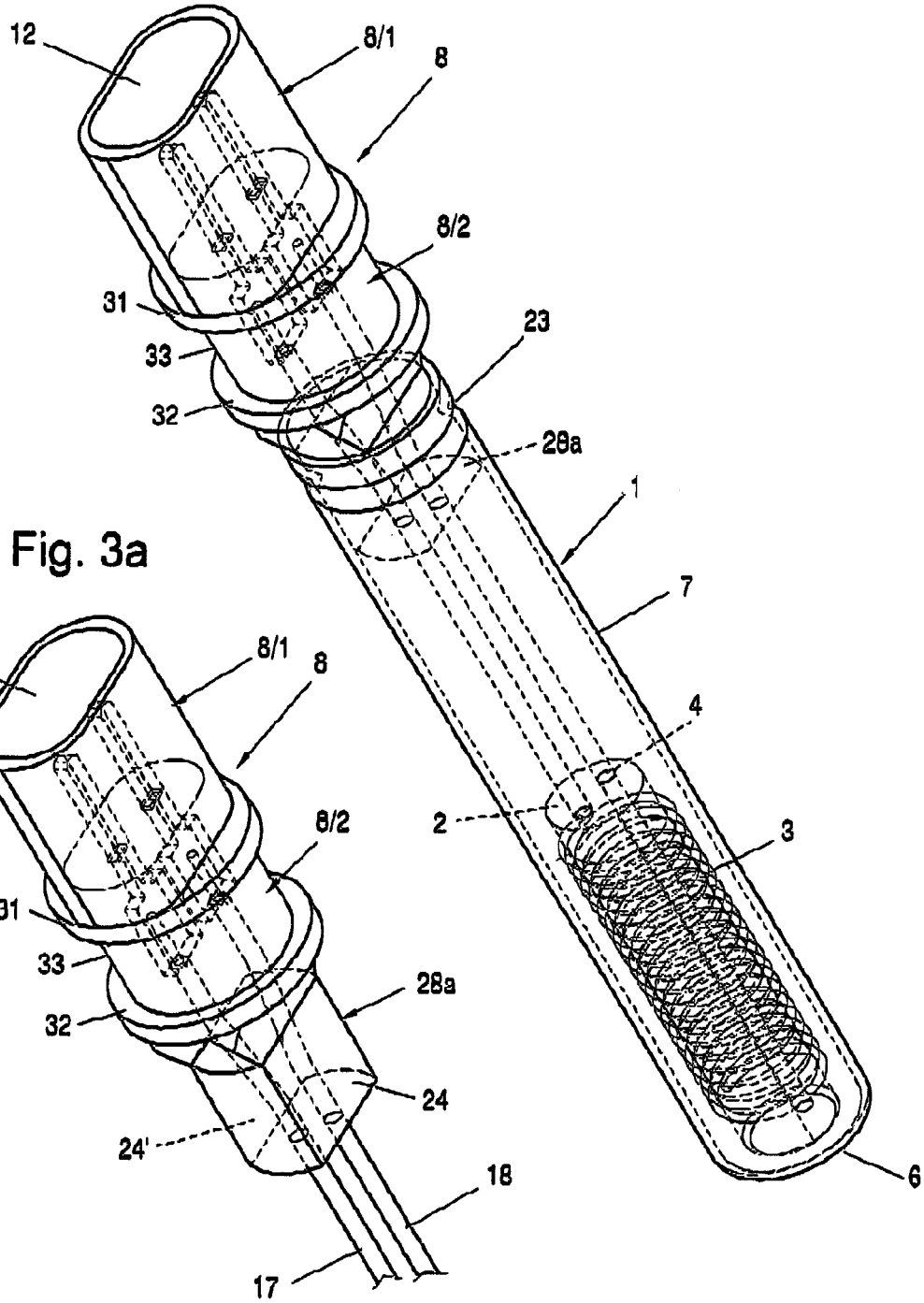
FIG. 3 is a 3D view of a heating cartridge with a coupling element, which is designed as a connector plug and holder at the same time.
Figure 3A:
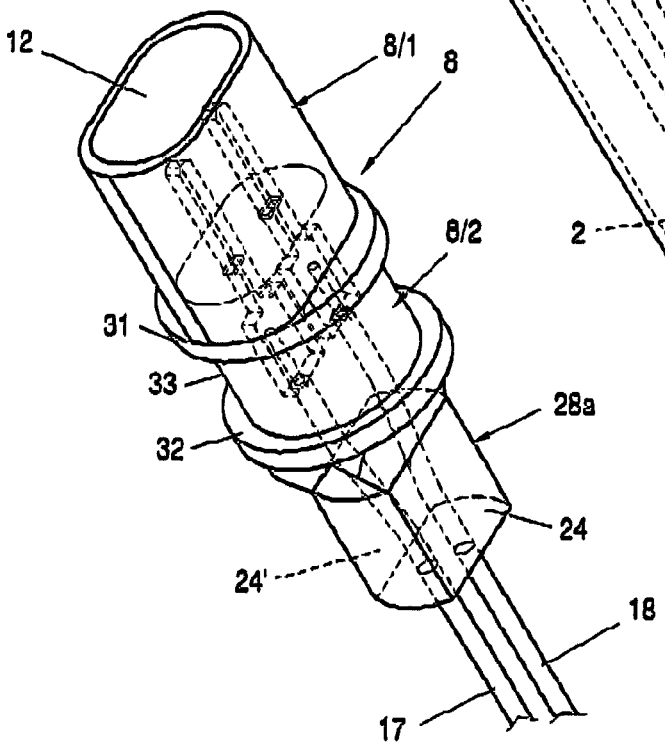
FIG. 3*a* is a 3D view of the coupling element according to FIG. 3 with electrical connection parts.

As is shown in FIGS. 3 and 3*a*, it may, on the other hand, be expedient and advantageous to design the coupling element 8 such that it can be used both as a connector plug and as a holder. The connector plug 8/1 and the holder 8/2 are combined in one piece in the coupling element 8 in this case.

Independently from these possible embodiments of the coupling element as a connector plug 8/1, as a holder 8/2 or as a combination of a connector plug 8/1 and a holder 8/2, the connection element is provided in all embodiments with a connection section 28, which protrudes into the upper, open end of the metal sheathing 7 and is fastened in the metal sheathing 7 of the heating cartridge 1 in a non-positive manner by preferably radial pressing. As is shown by the exemplary embodiments shown, this connection section 28 may have various designs, e.g., in the form 28*a*, 28*b* or 28*c*, and fastened in the metal sheathing 7 in different ways.

Thus, a reliable, rigid and stable connection can be guaranteed between the coupling element 8, on the one hand, and the heating cartridge 1 or the metal sheathing 7 thereof, on the other hand.

The winding support 2 with the winding 3 and with the connection wires 17, 18 connected thereto are inserted into the metal sheathing 7 together with the connection section 28*a*, 28*b*, 28*c*. The powdered insulating material filling 5 is introduced simultaneously or later and slightly compacted at first by shaking, so that no cavities will remain. To avoid contact between the resistance wire winding 3 and the metal sheathing 7 with certainty, the inner surface of the metal sheathing 7 may have a sleeve made of insulating material or a wound film made of insulating material at least in the axial area of the resistance wire winding 3.

Figure 9:
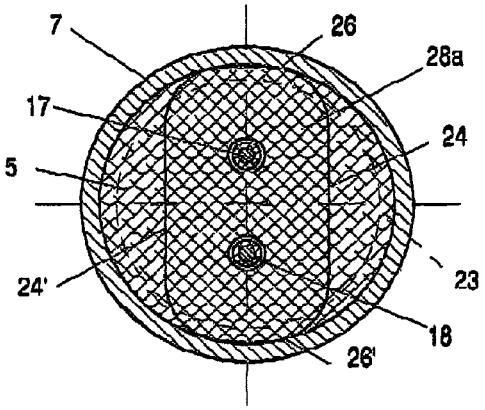
FIG. 9 is a section IX-IX from FIG. 8 in an enlarged view.

As is apparent from FIG. 9, the connection section 28*a* has, on both sides, flattened areas 24, 24', which are symmetrical to one another and whose narrow-side cylindrical sections 26, 26' are fittingly coordinated with the internal diameter of the metal sheathing 7. The connection section 28*b* according to FIGS. 5 and 6 has a cylindrical cross-sectional shape, which corresponds to the internal diameter of the metal sheathing 7.

Figure 10:
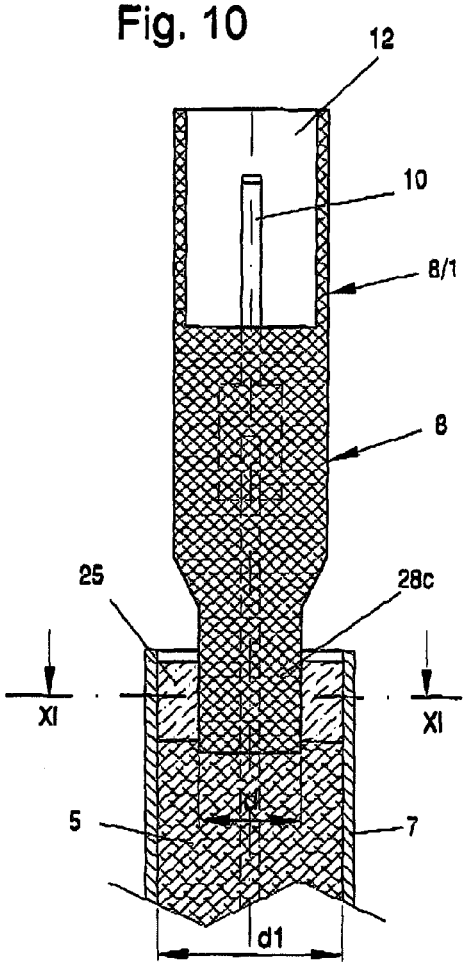
FIG. 10 is a section of the upper end section of the heating cartridge according to FIG. 5 but with a connection section of another design of the connector plug.
Figure 11:
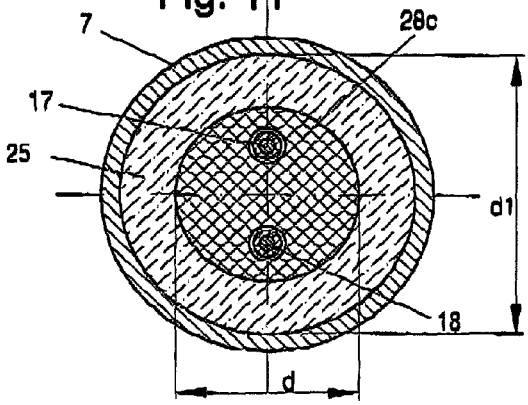
FIG. 11 is a section XI-XI from FIG. 10 in an enlarged view.

In another embodiment according to FIGS. 10 and 11, the cylindrical connection section 28*c* is provided with a diameter d, which is smaller than the internal diameter d1 of the metal sheathing 7. A closing ring 25 consisting of an insulating material, e.g., plastic or ceramic, which is pressed together with the metal sheathing 7 and the connection section 28*c*, is arranged in this embodiment in the annular gap present between the metal sheathing 7 and the connection section 28*c*.

Figure 7:
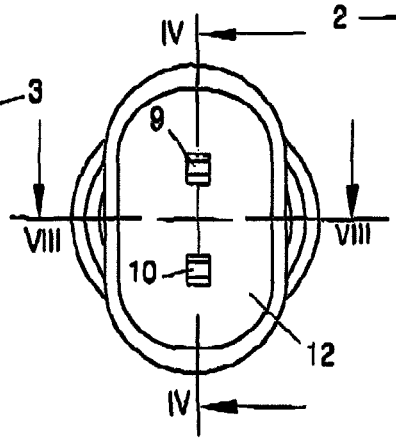
FIG. 7 is a front view VII from FIG. 4.

Just as in the embodiment according to FIGS. 2, 4 and 7 with the connection section 28*a*, it is, however, also possible to surround this connection section 28*c* with the insulating material filling 5 and to press it together with same.

Figure 8:
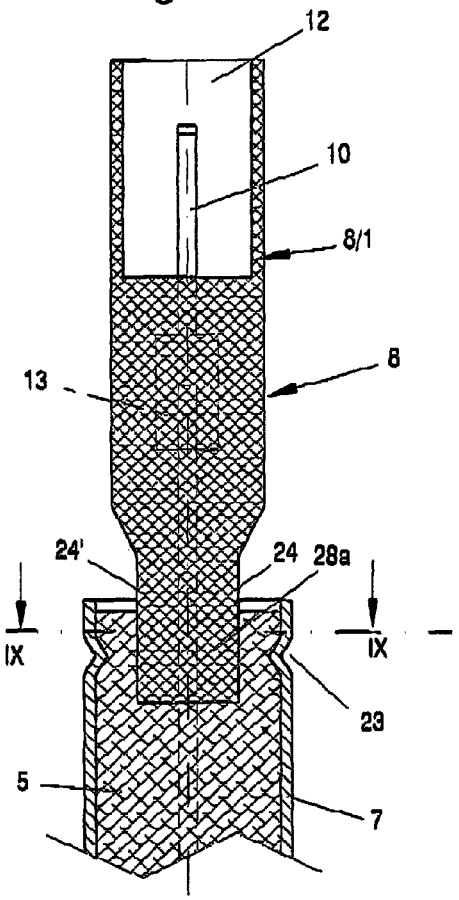
FIG. 8 is the upper end section of the heating cartridge according to FIGS. 1 and 4, which said end section is provided with the connector plug, along section line VIII-VIII from FIG. 7.

It is possible to fill the insulating material filling into the upper end of the metal sheathing 7 after insertion of the connection section 28*a* in case of both the laterally flattened cross-sectional shape according to FIGS. 2, 4 and 7 and the gap formed by the diameter reduction according to FIGS. 8 and 9, because these flattened areas or the gap leave a filling opening free.

To attain a higher tensile strength, the upper end of the metal sheathing 7 is provided with a circumferential, inwardly projecting ring bead 23, so that there also is a positive-locking connection with the narrow sides of the connection section 28*a* in addition to the non-positive connection or the connection in substance.

Figure 6:
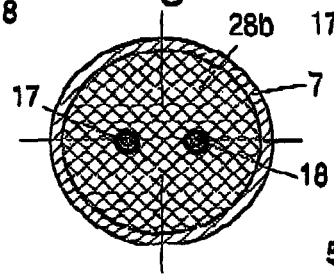
FIG. 6 is a section VI-VI from FIG. 5.

Such a ring bead 23 is also recommended in the embodiment according to FIGS. 5 and 6, in which the connection section 28*b* with its cylindrical shape is adapted to the internal diameter of the metal sheathing 7 and is pressed together with same or is embedded in same by injection molding.

It is clearly recognizable from the drawings that a very slender, radially only slightly projecting three-dimensional shape is obtained in case of such an embodiment of the coupling element 8.

Depending on the embodiment, the radial pressing of the heating cartridge and hence the compaction of the insulating material filling may be carried out before or after the embedding of the coupling element 8 by injection molding with one of the connection sections 28*a*, 28*b* or 28*c*.

Depending on the type of use and the specifications for installation, the connection sections 28 may be provided with a greater axial length than shown in order to achieve an even more stable connection to the metal sheathing 7.

Figure 12:
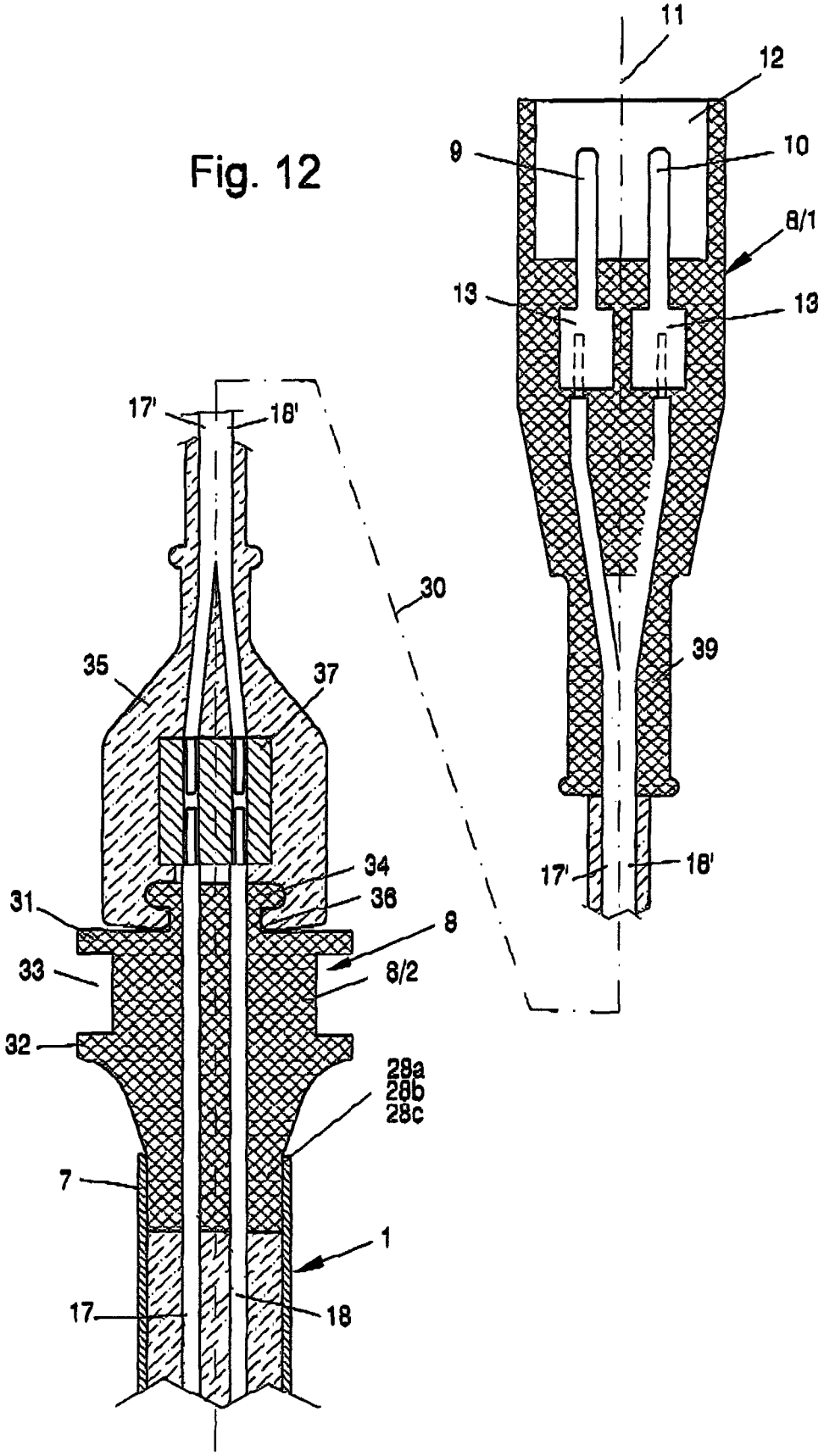
FIG. 12 is a section of an embodiment of the heating cartridge in which the holder and the connector plug are separate parts, which are connected to one another by a cable.

FIG. 12 shows an embodiment, in which the coupling element 8 designed as a holder 8/2 and the connector plug 8/1 are designed as separate plastic parts and are connected to one another electrically and physically by a cable 30. Holder 8/2, which has an outer shape corresponding to a preset receiving device (not shown), is provided, as in the above-described two embodiments, with a connection section having the shape 28*a*, 28*b* or 28*c*, by which it is fastened in the metal sheathing 7 in one of the ways described.

In the exemplary embodiment being shown, holder 8/2 has a cylindrical shape with an annular groove 33 located between two movable flanges 31, 32. A connection part 35 of cable 30, which connection part consists of an elastic insulating material and is provided with a ring lip 36 extending elastically behind the bead 34 in a positive-locking manner for this purpose, is fastened to a front-side central bead 34 of holder 8/2.

A cable connector 37, by which the connection wires 17, 18 led through the holder 8/2 are electrically connected to the conductors 17' and 18' of the cable in a suitable manner, is located in connection part 35.

Connector plug 8/1 has a shape similar to that in the embodiment according to FIGS. 1, 1*a* and 4 through 11. On its lower front side, it is provided with a socket 39, by which the conductors 17', 18' are connected to the foot parts 13 of the pins 9 and 10, respectively.

It shall be pointed out that the outer shape of both the connector plug 8/1 and of the holder 8/2 is freely selectable and is by no means bound to the shape of the exemplary embodiments shown. For example, the connector plug 8/1 may be arranged such that it extends at right angles or obliquely to the axis 11 of the heating cartridge 1 and of the holder 8/2.

While specific embodiments of the invention have been shown and described in detail to illustrate the application of the principles of the invention, it will be understood that the invention may be embodied otherwise without departing from such principles.

What is claimed is:

1. A heating cartridge for a thermostatic working valve, the heating cartridge comprising:

a winding support;

an insulating material filling;

a metal sheathing;

a resistance wire winding, which is wound on said winding support and which is arranged, embedded in said insulating material filling, in said metal sheathing;

a dimensionally stable coupling element at one end of said metal sheathing, said dimensionally stable coupling element being manufactured from a plastic; and connecting lines arranged in said plastic, said connecting lines electrically connecting to the ends of the resistance wire winding, said connecting lines being rigidly seated in said coupling element, said coupling element comprising at least one of a connector plug and a holder and said coupling element having a connection section, which protrudes into an open end of said metal sheathing and which is fastened in said metal sheathing by radial pressing of said metal sheathing, wherein said metal sheathing is connected to said coupling element in one or more of a non-positive manner and in a positive-locking manner, said at least one of said connector plug and said holder being located at a position outside of said metal sheathing, said at least one of said connector plug and said holder comprising an external device connection interface for connecting said coupling element to an external device, said dimensionally stable coupling element forming a structural unit with said metal sheathing.

2. A heating cartridge in accordance with claim 1, wherein said coupling element comprises said connector plug and said holder and has two pins connected to said connecting lines, said connector plug and said holder being located at a spaced location from said open end of said metal sheathing, wherein said connector plug and said holder are located at a position external to said metal sheathing, said coupling element being formed as a one-piece injection molding, in which said pins are embedded by injection molding or are plugged in later in said coupling element.

3. A heating cartridge in accordance with claim 1, wherein said connection section is fastened in said metal sheathing by pressing and has at least one recess in the form of a flattened area or of a hole, which forms an access opening to the interior space of said metal sheathing, wherein at least a portion of said connection section is located within said metal sheathing, said connection section being located at one end portion of said coupling element, wherein another end portion of said coupling section is located at a position external to said metal sheathing, whereby said another end portion of said coupling section is located at a spaced location from said open end of said metal sheathing.

4. A heating cartridge in accordance with claim 3, wherein said connection section is partially or fully embedded in said insulating material filling, at least a portion of said connection section engaging said insulating material.

5. A heating cartridge in accordance with claim 1, wherein said connection section has a round cross-sectional shape and is inserted directly into an end section of said metal sheathing, which said end section of said metal sheathing is not filled out by said insulating material filling, said connection section having a connection section dimension, said at least one of said connector plug and said holder having a dimension that is greater than said connection section dimension.

6. A heating cartridge in accordance with claim 1, wherein said metal sheathing is provided with a ring bead for grasping said connection section at least in a positive-locking manner.

7. A heating cartridge in accordance with claim 1, wherein said connection section has a cross section tapered compared to a portion of a body of said coupling element.

8. A heating cartridge in accordance with claim 1, wherein said connection section protrudes on a front side into said metal sheathing and has a smaller cross section than a cavity of said metal sheathing, and a closing ring formed of insulating material or metal is arranged in a gap present between said metal sheathing and a circumference of said connection section.

9. A heating cartridge in accordance with claim 2, wherein said pins embedded by injection molding protrude into a cavity of said connector plug, which said cavity is open on the end side, and said connector plug with said cavity and with said pins extends in parallel to an axis of said metal sheathing.

10. A heating cartridge in accordance with claim 1, wherein said pins embedded by injection molding protrude into a cavity of said connector plug, which said cavity is open on the end side, and that said connector plug with said cavity and with pins extends such that said connector plug is sloped obliquely in relation to an axis of said metal sheathing.

11. A heating cartridge in accordance with claim 1, wherein said connecting lines are designed as connection wires and are formed, between lead-out wires of said resistance wire winding, and pins of blank or sheathed conductor wires or conductor strands, which are embedded in the body of said coupling element and in said insulating material filling by injection molding.

12. A heating cartridge in accordance with claim 1, wherein said connector plug is arranged coaxially to said axis of said metal sheathing and pins extend axially in parallel in a symmetrical arrangement to said axis.

13. A heating cartridge in accordance with claim 1, wherein pins, said connecting lines and connection elements thereof are designed as a one-piece punched part.

14. A heating cartridge in accordance with claim 1, wherein said connection section of said coupling element extends up to said winding support of said wound-up resistance wire winding in said metal sheathing.

15. A heating cartridge in accordance with claim 1, wherein said ends of said connecting lines, which said ends are connected to lead-out wires, are mechanically connected to said winding support to form an assembly unit, said assembly unit being inserted in said metal sheathing.

16. A heating cartridge comprising:

a winding support;

an insulating material filling;

a metal sheathing;

a resistance wire winding, said wire winding being wound on said winding support and said winding support with said wire winding being arranged in said insulating material filling, in said metal sheathing;

a dimensionally stable coupling element at one end of said metal sheathing, said dimensionally stable coupling element being manufactured from a plastic and said dimensionally stable coupling element comprising at least one of a connector plug and a holder and said dimensionally stable coupling element having a connection section, which protrudes into an open end of said metal sheathing and which is fastened in said metal sheathing by a radial pressing connection, wherein said connection section is connected to said metal sheathing in one or more of a non-positive manner and in a positive-locking manner via said radial pressing connection, said dimensionally stable coupling element forming a structural unit with said metal sheathing, said at least one of said connector plug and said holder being located at a position external to said metal sheathing, said at least one of said connector plug and said holder defining an external device connection means for connecting said coupling element to an external device; and connecting lines arranged in said plastic, said connecting lines being electrically connecting to the ends of said wire winding, said connecting lines being rigidly seated in said coupling element.

17. A heating cartridge in accordance with claim 1, wherein said coupling element comprises said connector plug and said holder and has two pins connected to said connecting lines, said connector plug and said holder being located at a spaced location from said open end of said metal sheathing, wherein said connector plug and said holder are located at a position external to said metal sheathing, said coupling element being formed as a one-piece injection molding, in which said pins are embedded by injection molding or are plugged in later in said coupling element, at least a portion of said connection section being located within said metal sheathing, said connection section being located at one end portion of said coupling element, wherein another end portion of said coupling section is located at a position external to said metal sheathing, whereby said another end portion of said coupling section is located at a spaced location from said open end of said metal sheathing.

18. A heating cartridge in accordance with claim 1, wherein said winding support comprises an outer winding support surface, a first axially extending recess and a second axially extending recess, at least a portion of one of said connecting lines being arranged in said first axially extending recess, at least a portion of another one of said connecting lines being arranged in said second axially extending recess, said resistance winding engaging said outer winding support surface, wherein at least a portion of said resistance winding extends in a circumferential direction of said outer winding support surface, wherein said at least said portion of said connecting lines is in a fixed position relative to said plastic.

19. A heating cartridge in accordance with claim 17, wherein said winding support comprises an outer winding support surface, a first axially extending recess and a second axially extending recess, at least a portion of one of said connecting lines being arranged in said first axially extending recess, at least a portion of another one of said connecting lines being arranged in said second axially extending recess, said resistance winding engaging said outer winding support surface, wherein at least a portion of said resistance winding extends in a circumferential direction of said outer winding support surface, wherein said at least said portion of said connecting lines is in a fixed position relative to said plastic, said connection section being located at a spaced location from said winding support.

20. A heating cartridge comprising:

a winding support comprising a cylindrical support body;

an insulating material filling;

a metal sheathing comprising an end portion on one end thereof, said end portion defining an opening, said insulating material filling being arranged in said metal sheathing, wherein at least a portion of said metal sheathing engages said insulating material filling;

a resistance wire winding comprising a first end and a second end, said resistance wire winding being wound on said winding support, wherein at least a portion of said resistance wire winding engages said cylindrical support body and said at least said portion of said resistance wire winding extends in a circumferential direction of said cylindrical support body, said at least said portion of said resistance wire winding and at least a portion of said winding support engaging said insulating material filling;

a dimensionally stable coupling element at said one end of said metal sheathing, said dimensionally stable coupling element comprising a plastic, a connection section and a coupling element portion comprising one or more of a connector plug and a holder, at least a portion of said connection section extending into said opening of said metal sheathing, said connection section being fastened in said metal sheathing by a radial pressing of said metal sheathing, wherein said metal sheathing is connected to said connection section via one or more of a non-positive connection and a positive-locking connection, said dimensionally stable coupling element forming a structural unit with said metal sheathing, said coupling element portion extending from a first position to a second position, said first position and said second position being located outside of said metal sheathing, said first position being located adjacent to said end portion of said metal sheathing, said second position being located at an axially spaced location from said end portion of said metal sheathing with respect to a longitudinal axis of said metal sheathing, said one or more of said connector plug and said holder comprising a mechanical connection interface for at least mechanically connecting said coupling element to an external device; and a plurality of connecting lines, at least a portion of each of said connecting lines being arranged in said plastic, one of said connecting lines being electrically connecting to said first end of said resistance wire winding, another one of said connecting lines being electrically connected to said second end of said resistance wire winding, said connecting lines being rigidly seated in said coupling element.

* * * * *